United States Patent [19]

Porter

[11] Patent Number: 4,809,637

[45] Date of Patent: Mar. 7, 1989

[54] PLATFORM BRACKET

[76] Inventor: Stuart J. Porter, 2181 Mill Rd., Novato, Calif. 94947

[21] Appl. No.: 924,804

[22] Filed: Oct. 30, 1986

[51] Int. Cl.[4] ..... B63B 17/00

[52] U.S. Cl. ..... 114/362

[58] Field of Search ..... 114/362, 343, 344, 364, 114/221 R; 248/235; 403/108-109, 379, 190, 192; 108/152, 153

[56] References Cited

U.S. PATENT DOCUMENTS

| | | | |
|---|---|---|---|
| 2,937,766 | 5/1960 | Penn | 211/193 |
| 3,195,680 | 7/1965 | Thornburg et al. | 114/364 |
| 3,613,137 | 10/1971 | Eccles | 114/362 |
| 3,747,885 | 7/1973 | Ciancimino | 403/190 |
| 3,862,456 | 1/1975 | Fisher | 114/364 |
| 4,085,473 | 4/1978 | Franklin | 114/364 |

*Primary Examiner*—Joseph F. Peters, Jr.
*Assistant Examiner*—Jesûs D. Sotelo
*Attorney, Agent, or Firm*—Larry D. Johnson

[57] ABSTRACT

A platform bracket utilizes a two-piece construction providing secure attachement of a swim board to a boat transom, while simplifying removal of the swim board from the boat when desired. The first piece is a wall portion that bolts directly to the boat transom with through-bolts. This wall portion includes a transom plate for attachment to the transom, and a longitudinal shaft or post, which is slightly spaced from the transom plate by a narrow shim, and is secured there with its longitudinal axis parallel to the plane of the transom plate, so that the post is oriented generally vertically when the transom plate is bolted to the transom. The second piece of the platform bracket is a separate shelf portion, which screws directly to the swim board itself. The shelf portion includes a support plate for attachment to the swim board; a hollow jacket or receiver, which is mounted at an angle so that the plane of the swim board will be parallel to the water's surface; and, if necessary, a brace member triangulating the two. The hollow receiver is sized to fit over the post of the wall portion, with a channel cut-out to accomodate the post's shim. A cotter pin or other locking mechanism fits through a hole in the hollow receiver and post to lock the two in place, thereby securing the swim board to the boat. Thus, the swim board can be easily removed from the boat after installation by simply removing the cotter pin and lifting the swim board from the fixed transom.

4 Claims, 1 Drawing Sheet

PLATFORM BRACKET

BACKGROUND OF THE INVENTION

1. Field of the Invention

This invention relates generally to hardware and support apparatus, and more specifically to an improved bracket device for supporting a platform.

2. Description of the Prior Art

Many small boats are equipped with a wooden or plastic platform or swim board, typically bolted to the boat's transom, to assist swimmers and skiers into and out of the boat. Because of the significant stresses that can be applied to such a swim board due to passenger loading and unloading, as well as due to the contact with the water when the boat is underway, it is imperative that the swim board be securely fastened to the boat. Accordingly, many swim boards are simply (and essentially permanently) bolted to the transom. However, such attachment makes it difficult to remove the swim board from the boat when desired. Other existing brackets incorporate some form of release device to simplify the removal of the swim board from the boat, but these release devices regularly jam or break due to the applied stresses.

SUMMARY OF THE INVENTION

The improved platform bracket of this invention utilizes a two-piece construction that provides secure attachment of a swim board to a boat transom, while permitting quick and easy removal of the swim board from the boat when desired. One piece of the platform bracket is a wall portion that bolts directly to the boat transom with through-bolts. This wall portion includes a transom plate for attachment to the transom, and a longitudinal shaft or post, which is slightly spaced from the transom plate by a narrow shim, and is secured there with its longitudinal axis parallel to the plane of the transom plate, so that the post is oriented generally vertically when the transom plate is bolted to the transom. The other piece of the platform bracket is a separate shelf portion, which screws directly to the swim board itself. The shelf portion includes a support plate for attachment to the swim board; a hollow jacket or receiver, which is mounted at an angle so that the plane of the swim board will be parallel to the water's surface; and, if necessary, a brace member triangulating the two. The hollow receiver is sized to fit over the post of the wall portion, with a channel cut-out to accomodate the post's shim. A cotter pin or other locking mechanism fits through a hole in the hollow receiver and solid rod to lock the two in place, thereby securing the swim board to the boat. Thus, the swim board can be easily removed from the boat after installation by simply removing the cotter pin and lifting the swim board from the fixed transom.

This improved bracket can be modified, if necessary, to fit practically any size and type of boat. For example, it is of course desirable to mount the swim board parallel to the water's surface. Because of the variation in the angle of different boat's transoms, it may be necessary to adjust the angle between the support plate and receiver so that the support plate, and thus the swim board, is parallel to the water. It has been found that an angle of between 80 and 140 degrees (relative to the transom) may be necessary for particular applications. Furthermore, this platform bracket can be used with non-planar (e.g., curved) transoms, by appropriate repositioning of the receiver's channel cut-out.

This improved bracket is suitable not only as original equipment on a boat, but as an aftermarket item to add a swim board to a boat, or replace existing brackets on a boat already equipped with a swim board. In replacement applications, it is suggested that the bolt holes in the transom plate be made in the existing size and spacing of the previous bracket, and that the same through-bolts be used there. However, the screw holes in the support plate should preferably not be in the existing positions, so that new screw holes can be placed into the wood or plastic of the swim board.

DETAILED DESCRIPTION OF A PREFERRED EMBODIMENT

Figure 1:
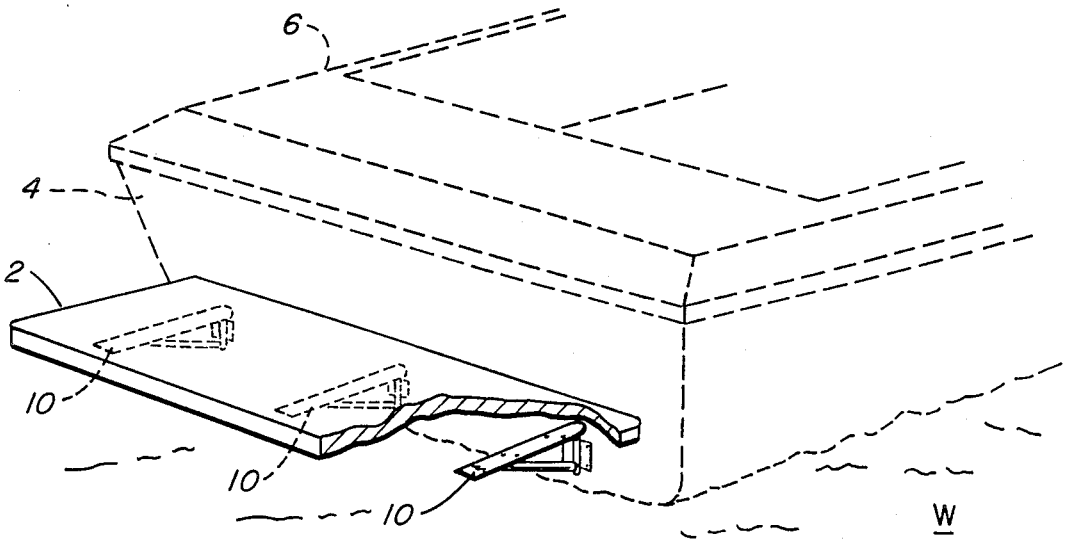
FIG. 1 is a partially cutaway perspective view of a series of three platform brackets of this invention as used to mount a swim board to the transom of a boat.

FIG. 1 illustrates a partially cutaway perspective view of a typical application of the platform bracket of this invention. In FIG. 1, a swim board 2 is attached to a transom 4 of a boat 6 by means of a series of three platform brackets 10. As can be appreciated from this illustration, it is important that the swim board be securely attached to the boat, and further that the swim board should be mounted so that its plane is parallel to the surface of the water W.

Figure 2:
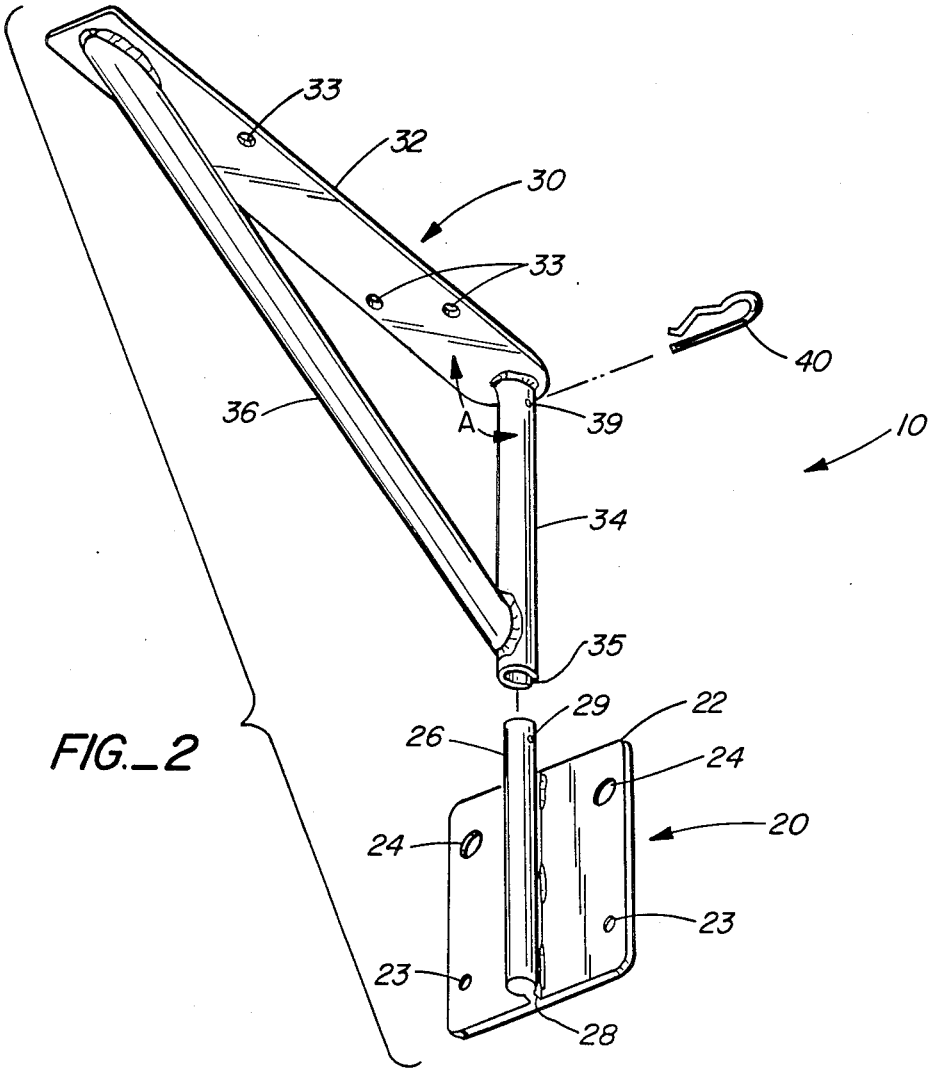
FIG. 2 is an exploded perspective view of a single platform bracket.

Referring now to FIG. 2 with greater particularity, an exploded perspective view of a single platform bracket 10 is shown. Platform bracket 10 comprises essentially two parts: a wall portion 20 and a shelf portion 30. Wall portion 20 includes a transom plate 22, which is through-bolted to the boat transom through bolt holes 23, 24. Mounted to the outside surface of transom plate 22 is a longitudinal shaft or post 26, which is slightly spaced from the surface of the transom plate by a narrow shim 28. Post 26 is preferably cylindrical in shape, but can of course be of other shapes. In the typical construction of the platform bracket, stainless steel or similar material is used, and shim 28 can be standard $\frac{1}{4}''$–5/16″ key stock that is TIG (tungsten inert gas) welded to the transom plate 22 and post 26. The post 26 is oriented so that when the transom plate 22 is mounted to the boat, post 26 is generally vertical.

Shelf portion 30 includes a horizontal support plate 32, which attaches directly to a swim board with screws through screw holes 33. A hollow jacket or receiver 34 is secured generally perpendicular to the plane of support plate 32, and includes a narrow channel cut-out 35 along its outside, vertical dimension. Receiver 34 is preferably tubular in shape, but should of course be of whatever shape necessary to accomodate post 26. The angle A between support plate 32 and receiver 34 can be adjusted at manufacture to accomodate various angles of boat transoms, as needed. A brace member 36 fastened between support plate 32 and receiver 34 serves to triangulate the structure, and provide increased strength to the shelf portion 30.

Once wall portion 20 has been bolted to the transom, and shelf portion 30 has been screwed to the swim board, the two components are joined by aligning the receiver 34 over the post 26, and sliding the receiver over the post, so that the channel cut-out 35 of the receiver engages the shim 28 of the wall portion. The receiver can be slid down over the post until the top of the post contacts the base of the support plate 32. A hairpin cotter 40, or other locking mechanism, can then be inserted through the holes 29 and 39, drilled through post 26 and receiver 34, respectively, to lock the two parts in place, thereby securing the swim board to the boat.

Removal of the swim board from the boat is simply the reverse of the mounting process: pin 40 is removed, and shelf portion 30 is lifted off of and away from wall portion 20, leaving the boat transom relatively free from protuberances.

While this invention has been described in connection with preferred embodiments thereof, it is obvious that modifications and changes therein may be made by those skilled in the art to which it pertains without departing from the spirit and scope of the invention. For example, the design of this improved platform bracket can be easily modified in size and shape to accomodate virtually any application where secure attachment and easy removal of a shelf, platform or other structure is needed. Accordingly, the scope of this invention is to be limited only by the appended claims.

What is claimed as invention is:

1. A platform bracket for supporting a swim board from a boat transom comprising:

a transom plate member for attachment to a transom;

a post member having a longitudinal axis, said post member fixedly connected to said transom plate member by a shim so that said post member's longitudinal axis is generally parallel to said transom plate member;

a support plate member having an upper surface and a lower surface, said upper surface conditioned for attachment to a swim board;

a generally hollow receiver member having a longitudinal axis and a top surface, said receiver member top surface connected to and covered by said support plate member lower surface so that said receiver member's longitudinal axis is generally perpendicular to said support plate member;

a channel in one side of said receiver member, wherein said post member is insertable within said receiver member so that said shim engages said channel, and said support plate member is supported in a generally horizontal orientation; and a locking mechanism to secure said post member within said receiver member.

2. The platform bracket of claim 1 including a brace member triangulating said support plate member and said receiver member.

3. The platform bracket of claim 1 wherein said locking mechanism comprises a hairpin cotter.

4. The platform bracket of claim 1 wherein said post member comprises a solid cylindrical rod, and said receiver member comprises a tubular, channelized jacket.

* * * * *